US012781750B2

(12) United States Patent
Hiradate et al.

(10) Patent No.: US 12,781,750 B2
(45) Date of Patent: Nov. 3, 2026

(54) CENTRIFUGAL FLUID MACHINE AND SINGLE-SHAFT MULTI-STAGE CENTRIFUGAL COMPRESSOR

(71) Applicant: Hitachi Industrial Products, Ltd., Tokyo (JP)

(72) Inventors: Kiyotaka Hiradate, Tokyo (JP); Ryuichi Hashimoto, Tokyo (JP)

(73) Assignee: HITACHI INDUSTRIAL PRODUCTS, LTD., Tokyo (JP)

( * ) Notice: Subject to any disclaimer, the term of this patent is extended or adjusted under 35 U.S.C. 154(b) by 0 days.

(21) Appl. No.: 19/106,868

(22) PCT Filed: Nov. 27, 2023

(86) PCT No.: PCT/JP2023/042344
§ 371 (c)(1),
(2) Date: Feb. 26, 2025

(87) PCT Pub. No.: WO2024/122378
PCT Pub. Date: Jun. 13, 2024

(65) Prior Publication Data

US 2026/0078761 A1 Mar. 19, 2026

(30) Foreign Application Priority Data

Dec. 7, 2022 (JP) ..... 2022-195613

(51) Int. Cl.
*F04D 17/12* (2006.01)
*F04D 29/44* (2006.01)

(52) U.S. Cl.
CPC ..... *F04D 17/12* (2013.01); *F04D 29/441* (2013.01)

(58) Field of Classification Search
CPC ..... F04D 17/12; F04D 17/122; F04D 29/42; F04D 29/4206; F04D 29/4213; F04D 29/44; F04D 29/441
See application file for complete search history.

(56) References Cited

U.S. PATENT DOCUMENTS

2016/0327056 A1* 11/2016 Nakaniwa ..... F04D 27/0238
2017/0254344 A1* 9/2017 Nakaniwa ..... F01D 25/002
2017/0370377 A1* 12/2017 Nakaniwa ..... F04D 29/444

FOREIGN PATENT DOCUMENTS

JP 04-109498 U 9/1992
JP 2010-236401 A 10/2010
WO 2016/121046 A1 8/2016

OTHER PUBLICATIONS

International Search Report of PCT/JP2023/042344 dated Feb. 6, 2024.

* cited by examiner

*Primary Examiner* — Elton K Wong
(74) *Attorney, Agent, or Firm* — MATTINGLY & MALUR, PC

(57) ABSTRACT

A centrifugal fluid machine includes: a rotary shaft; a plurality of centrifugal impellers; a bearing; and a casing. An intake flow path is provided in the casing, and includes: a first intake nozzle; an annular flow path part provided around the rotary shaft; an L-shaped bend part which redirects the flow in an axial direction of the rotary shaft; a second intake nozzle provided in the casing on the side opposite to the first intake nozzle and connected to the annular flow path part; and a rotation prevention plate. The first intake nozzle is arranged toward a direction of the rotary shaft, and the second intake nozzle is arranged in a direction deviated therefrom. The first and second intake nozzles are equipped with an inflow control device. Accordingly, pre- (Continued)

rotation is applied to the working fluid from the intake nozzle and the flow rate distribution is suppressed from becoming non-uniform.

15 Claims, 8 Drawing Sheets

CENTRIFUGAL FLUID MACHINE AND SINGLE-SHAFT MULTI-STAGE CENTRIFUGAL COMPRESSOR

TECHNICAL FIELD

The present invention relates to a centrifugal fluid machine and a single-shaft multi-stage centrifugal compressor, and particularly to the shape of their intake flow paths.

BACKGROUND ART

In various plants, a single-shaft multi-stage centrifugal compressor having a plurality of centrifugal impellers provided in multiple stages on a single rotary shaft is used in order to boost the pressure of a process gas. This single-shaft multi-stage centrifugal compressor is configured to suck a process gas from an intake nozzle which forms an intake flow path and introduce it into an annular flow path part, then compress and boost the gas sequentially by means of the centrifugal impellers provided in multiple stages on the rotary shaft, and thereafter discharge it from a discharge nozzle.

As an example of such a single-shaft multi-stage centrifugal compressor, there has been known one described in WO2016/121046 (Paten Literature 1). In this Patent Literature 1, the flow of a process gas sucked in from an intake nozzle is bent in an intake volute (annular flow path part) so as to follow the axis of a rotary shaft, and flows into the first-stage centrifugal impeller. Further, in order to suppress pressure loss when the flow is bent, a plurality of intake nozzles which communicate with the intake volute to enable the intake volute to suck a working fluid (gas) from the outside are configured to be provided at intervals in the circumferential direction of the rotary shaft. The intake nozzles are arranged to face the direction of the rotary shaft.

In the compressor described in Patent Literature 1, the fluids flowing into the intake volute from each intake nozzle are made to collide with each other within the intake volute, thereby making it possible to suddenly bend the flow direction of each fluid toward the axial direction of the rotary shaft. Therefore, the flow to the centrifugal impeller installed downstream of the intake flow path can be made to flow into the impeller in a state in which a rotation velocity component in the circumferential direction relative to the rotary shaft is removed. Further, since the multiple intake nozzles are provided so as to face toward the center of the rotary shaft, the fluid can be made to flow from the intake nozzle so that it becomes uniform in the circumferential direction within the intake volute, thereby making it possible to introduce a flow with a flow rate distribution uniformized in the circumferential direction into the impeller.

CITATION LIST

Patent Literature

Patent Literature 1: WO 2016/121046

SUMMARY OF INVENTION

Technical Problem

Depending on the type of plant in which a single-shaft multi-stage centrifugal compressor is used, the installed single-shaft multi-stage centrifugal compressor may be required to ensure a stable operation over a wide range of flow rates from the rated flow rate to a significantly small flow rate while maintaining the rated discharge pressure.

As a commonly known means for expanding the stable operation range in a single-shaft multi-stage centrifugal compressor to the small flow rate side, there has been known a method of allowing a pre-rotation flow having a rotation component in the same direction as the rotation direction of the centrifugal impeller to flow into an intake port of the first-stage centrifugal impeller located immediately downstream of the intake flow path in a state in which a flow rate distribution in the circumferential direction is as uniform as possible.

However, the application of pre-rotation to the first-stage centrifugal impeller also simultaneously brings about a reduction in the discharge pressure of the single-shaft multi-stage centrifugal compressor. Therefore, as described above, in order to ensure the stable operation range from the rated flow rate to the small flow rate side while maintaining the rated discharge pressure, as described in Patent Literature 1, it is required that the single-shaft multi-stage centrifugal compressor is not always operated in a pre-rotation free state, but is operated without application of pre-rotation at the rated flow rate, while it is operated with pre-rotation applied to the first-stage centrifugal impeller only when the flow rate of the working fluid is reduced.

As a means of operating a single-shaft multi-stage centrifugal compressor while controlling the amount of prep-rotation to the first-stage centrifugal impeller in this way, it is also known to install an inlet guide vane having a vane drive mechanism which changes a vane mounting angle, inside the intake flow path.

However, when the compressor has a drive mechanism like the inlet guide vane, the reliability of a moving part is deteriorated when the frequency of change of the mounting angle of the inlet guide vane is high. Further, when the working fluid is taken into the compressor from one intake nozzle, the working fluid flows selectively through the annular flow path part near the installation position of the intake nozzle. Therefore, when the mounting angle of the inlet guide vane is changed to apply pre-rotation, and the compressor is operated, there is an issue that the flow rate distribution is not sufficiently uniformized in the circumferential direction and flows into the first-stage centrifugal impeller.

An object of the present invention is to provide a centrifugal fluid machine and a single-shaft multi-stage centrifugal compressor which can apply pre-rotation to a working fluid from an intake nozzle and also suppress a flow rate distribution from becoming non-uniform.

Solution to Problem

In order to solve the above problem, a centrifugal fluid machine of this invention includes: a rotary shaft; a centrifugal impeller which is attached to the rotary shaft; a bearing which supports the rotary shaft; and a casing which accommodates the rotary shaft and the centrifugal impeller. The centrifugal fluid machine includes an intake flow path which is provided in the casing on the upstream side of the centrifugal impeller and introduces a working fluid from a radial direction of the rotary shaft to cause the working fluid to flow into the centrifugal impeller. The intake flow path includes: a first intake nozzle introducing the working fluid; an annular flow path part provided around the rotary shaft and connected to the first intake nozzle; an L-shaped bend part which is provided between the annular flow path part and an inlet of the centrifugal impeller and redirects a flow of the working fluid in an axial direction of the rotary shaft; a second intake nozzle provided in the casing on the side opposite to the first intake nozzle and connected to the annular flow path part; and a rotation prevention plate provided on the side opposite to the first intake nozzle in the annular flow path part. The first intake nozzle is arranged toward a direction of the rotary shaft, the second intake nozzle is arranged in a direction deviated from the direction of the rotary shaft, and the first intake nozzle and the second intake nozzle are each equipped with an inflow control device which controls an inflow of the working fluid introduced into a compressor from each of the first intake nozzle and the second intake nozzle.

As another feature of the present invention, a single-shaft multi-stage centrifugal compressor includes: a rotary shaft; a plurality of centrifugal impellers which are attached to the rotary shaft; a bearing which supports the rotary shaft; and a casing which accommodates the rotary shaft and the centrifugal impellers. The single-shaft multi-stage centrifugal compressor includes an intake flow path provided in the casing on the upstream side of the first-stage centrifugal impeller. The intake flow path includes: a first intake nozzle which introduces a working fluid; an annular flow path part provided around the rotary shaft and connected to the first intake nozzle; an L-shaped bend part which is provided between the annular flow path part and an inlet of the first-stage centrifugal impeller and redirects a flow of the working fluid in an axial direction of the rotary shaft; a second intake nozzle provided in the casing on the side opposite to the first intake nozzle and connected to the annular flow path part; and a rotation prevention plate provided on the side opposite to the first intake nozzle in the annular flow path part. The first intake nozzle is arranged toward a direction of the rotary shaft, the second intake nozzle is arranged in a direction deviated from the direction of the rotary shaft, and the first intake nozzle and the second intake nozzle are each equipped with an inflow control device which controls an inflow of the working fluid introduced from each of the first and second intake nozzles into the compressor.

As further another feature of the present invention, a single-shaft multi-stage centrifugal compressor includes: a rotary shaft; a plurality of centrifugal impellers which are attached to the rotary shaft; a bearing which supports the rotary shaft; and a casing which accommodates the rotary shaft and the centrifugal impellers. The single-shaft multi-stage centrifugal compressor includes an intake flow path provided in the casing on the upstream side of the first-stage centrifugal impeller. The intake flow path includes: a first intake nozzle which introduces a working fluid; an annular flow path part provided around the rotary shaft and connected to the first intake nozzle; an L-shaped bend part which is provided between the annular flow path part and an inlet of the first-stage centrifugal impeller and redirects a flow of the working fluid in an axial direction of the rotary shaft; a second intake nozzle provided in the casing on the side opposite to the first intake nozzle and connected to the annular flow path part; a third intake nozzle provided in the casing between the first intake nozzle and the second intake nozzle and connected to the annular flow path part; and a rotation prevention plate provided on the side opposite to the first intake nozzle in the annular flow path part. The first intake nozzle is arranged toward a direction of the rotary shaft, and the second intake nozzle and the third intake nozzle are arranged toward a direction deviated from the direction of the rotary shaft. The second intake nozzle and the third intake nozzle are arranged on the left and right of the rotation prevention plate so as to sandwich the rotation prevention plate, and the first intake nozzle, the second intake nozzle, and the third intake nozzle each include an inflow control device which controls an inflow of the working fluid introduced from each intake nozzle into the compressor.

Advantageous Effects of Invention

According to the present invention, it brings about the advantage that it is possible to obtain a centrifugal compressor and a single-shaft multi-stage centrifugal compressor capable of applying pre-rotation to a working fluid from an intake nozzle, and also suppressing a flow rate distribution from becoming non-uniform.

DESCRIPTION OF EMBODIMENTS

Figure 1:
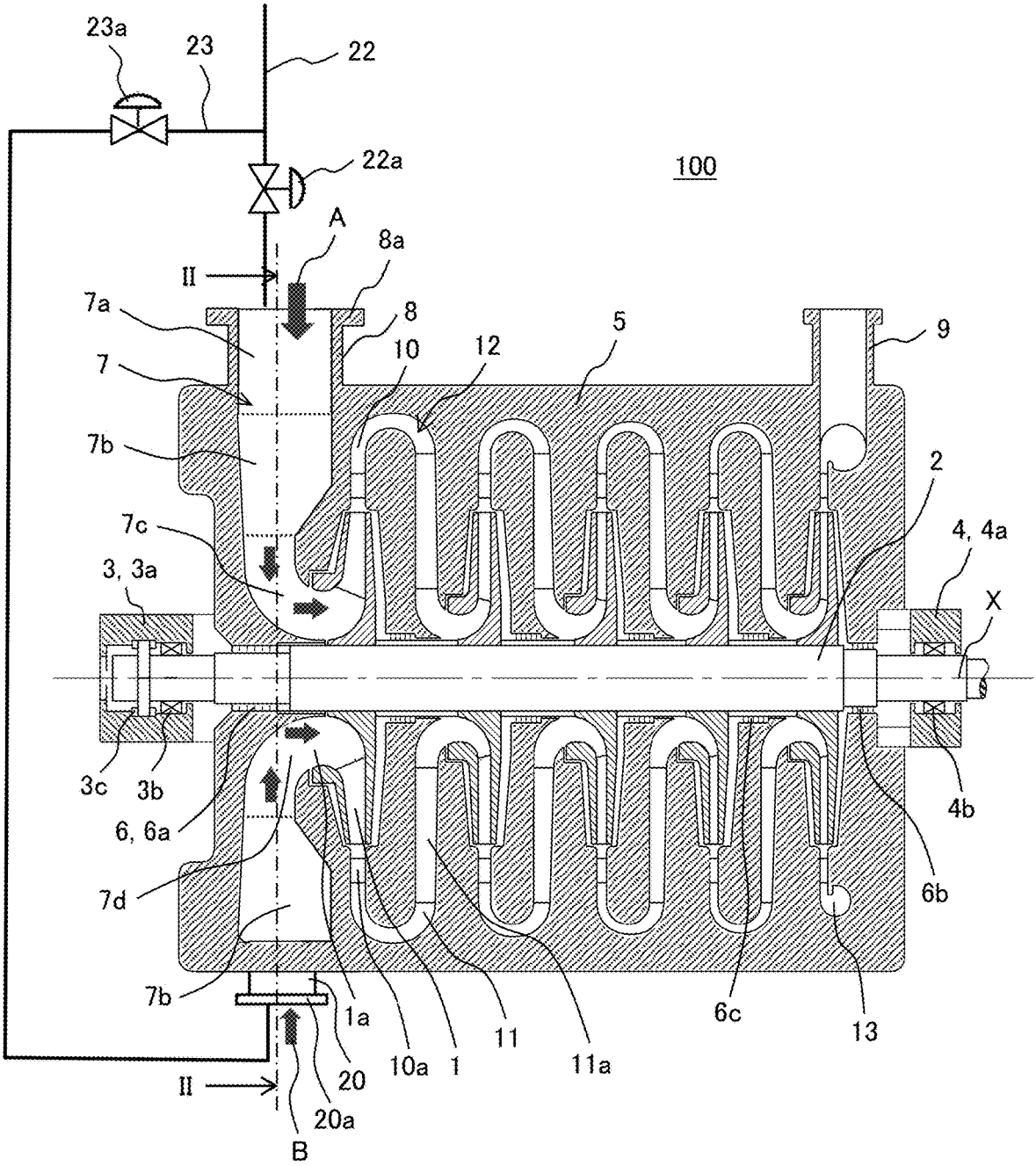
FIG. 1 is a longitudinal cross-sectional view of a single-shaft multi-stage centrifugal compressor showing a first embodiment of the present invention.

Hereinafter, embodiments will be described in detail with reference to the drawings. Note that in each drawing, parts given the same reference numerals indicate the same or corresponding parts. Further, in the following description, an example in which the present invention is applied to a single-shaft multi-stage centrifugal compressor will be described, but the present invention can also be applied to centrifugal fluid machinery such as a single-stage centrifugal compressor and a single-shaft multi-stage centrifugal pump.

First Embodiment

Figure 7:
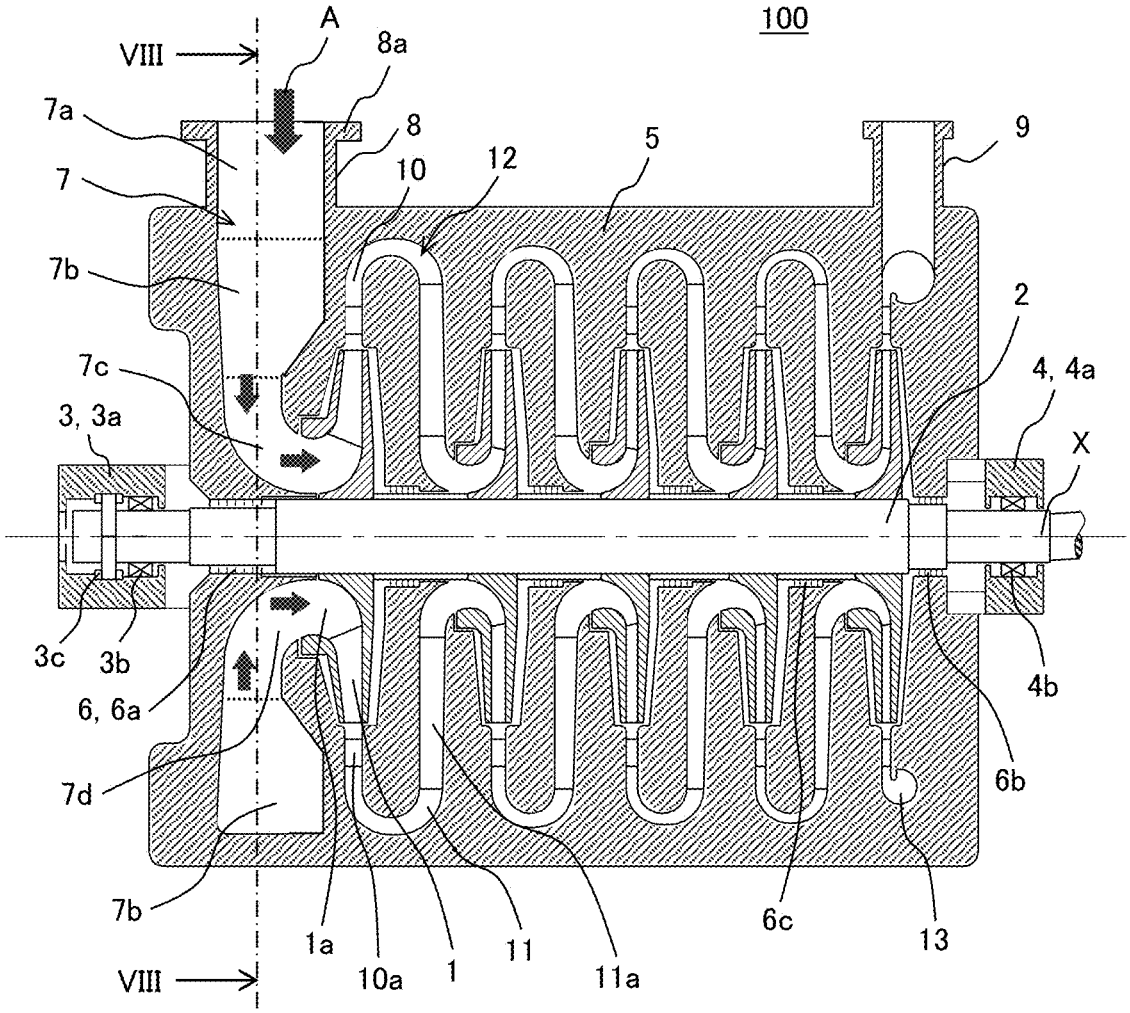
FIG. 7 is a longitudinal cross-sectional view showing a general single-shaft multi-stage centrifugal compressor.
Figure 8:
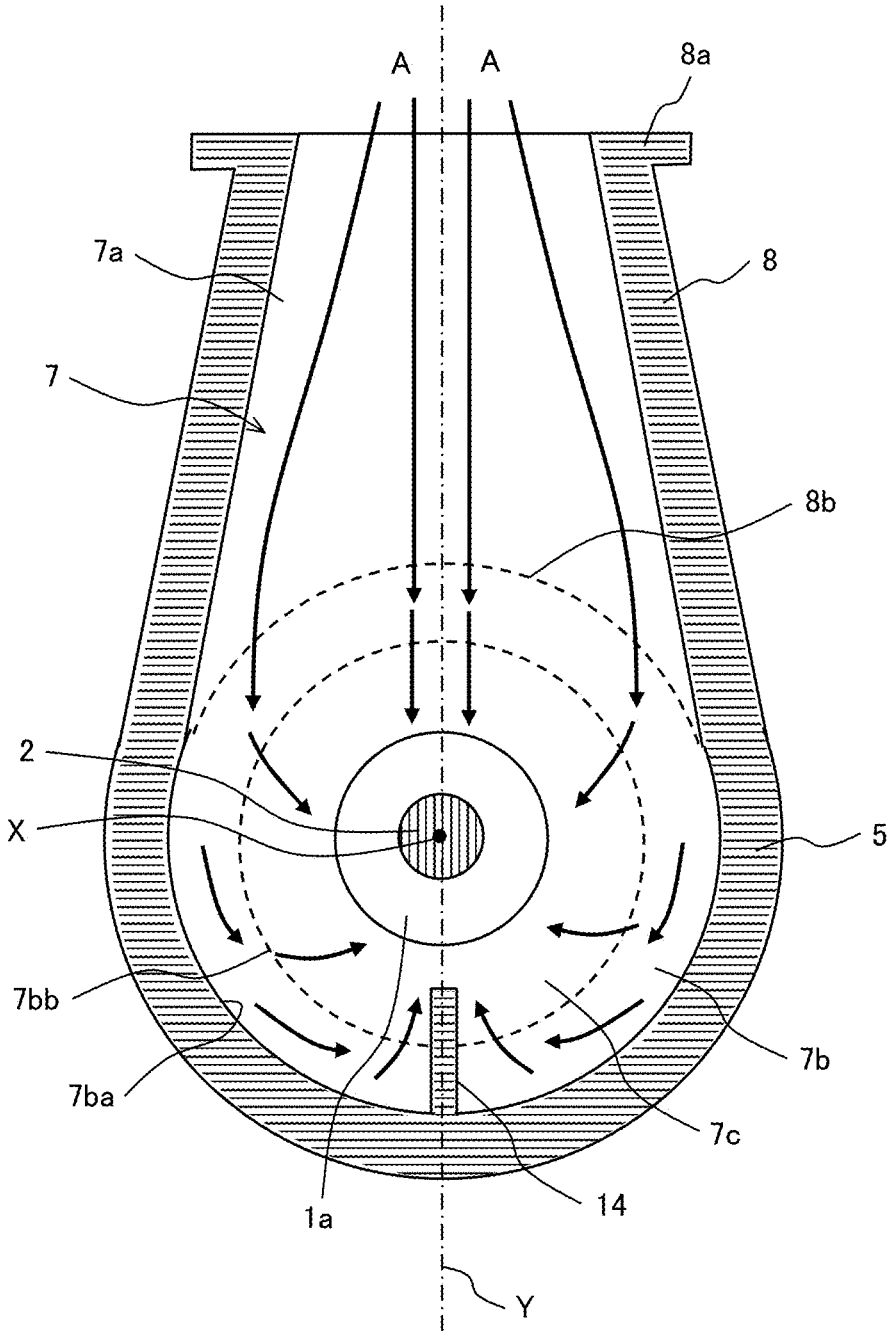
FIG. 8 is a cross-sectional view as seen in the direction indicated by arrows VIII, VIII in FIG. 7.

First, a description will be made about a conventional general single-shaft multi-stage centrifugal compressor using FIGS. 7 and 8. FIG. 7 is a longitudinal cross-sectional view showing a general single-shaft multi-stage centrifugal compressor, and FIG. 8 is a cross-sectional view as seen in the direction indicated by arrows VIII, VIII in FIG. 7.

As shown in FIG. 7, the single-shaft multi-stage centrifugal compressor 100 includes a plurality of centrifugal impellers 1 attached in multiple stages to a single rotary shaft 2 provided in a cylindrical casing 5. Both end sides of the rotary shaft 2 are rotatably supported by a bearing device 3 and a bearing device 4 provided in the casing 5 or the like. The bearing device 3 is constituted of a bearing case 3*a*, and a bearing (journal bearing) 3*b* and a thrust bearing 3*c* held in the bearing case 3*a*. The bearing device 4 is constituted of a bearing case 4*a*, and a bearing (journal bearing) 4*b* held in the bearing case 4*a*.

Also, in order to prevent air or the like of outside the machine from flowing directly into the first-stage centrifugal impeller 1, there is provided a shaft seal device 6*a* disposed at a portion between the intake side of the first-stage centrifugal impeller 1 and the bearing device 3 and through which the rotary shaft 2 of the casing 5 penetrates, with a small gap between the shaft seal device 6*a* and the rotary shaft 2. Further, in order to prevent a working fluid (working gas) discharged from the final-stage centrifugal impeller 1 from leaking directly outside the machine without flowing into a scroll 13, there is provided a shaft seal device 6*b* disposed even at a portion between the final-stage centrifugal impeller 1 and the bearing device 4 and through which the rotary shaft 2 of the casing 5 penetrates, with a small gap between the shaft seal device 6*b* and the rotary shaft 2. In addition, a shaft seal device 6*c* is provided between the centrifugal impellers 1 of each stage. Labyrinth seals are normally used as these shaft seal devices 6 (6*a*, 6*b*, and 6*c*).

The shape of an intake flow path 7 which introduces the working fluid to the first-stage centrifugal impeller 1 is different from stationary flow paths 12 of the other stages. That is, the intake flow path 7 is formed at the end (intake side) of the first-stage centrifugal impeller 1 side of the cylindrical casing 5 which houses the centrifugal impeller 1 and the rotary shaft 2, and is configured so that the first-stage centrifugal impeller 1 is allowed to take axial suction in order to introduce the working fluid from the radial direction of the rotary shaft 2 and cause it flow into the first-stage centrifugal impeller 1.

For this reason, the intake flow path 7 is provided on the intake side (upstream side) of the first-stage centrifugal impeller 1 in the casing 5, and includes, as shown in FIG. 8, an intake nozzle 8 having a flow path part 7*a* for introducing the working fluid, an annular flow path part 7*b* provided around the rotary shaft 2 and connected to the intake nozzle 8, an L-shaped bend part 7*c* provided between the annular flow path part 7*b* and the inlet of the centrifugal impeller 1 and redirecting the flow of the working fluid in the axial direction of the rotary shaft, and a rotation prevention plate 14 provided on the opposite side to the intake nozzle 8 at the annular flow path part 7*b*. Further, the intake nozzle 8 is arranged toward the direction of the rotary shaft 2.

As shown in FIG. 8, in the intake nozzle 8, an inlet (flange portion 8*a*) thereof is circular in cross section. As it approaches the annular flow path part 7*b* on the inner diameter side, the cross-sectional shape is formed into an oval shape which is plane symmetrical about a center line Y of the intake flow path 7. The working fluid sucked from the intake nozzle 8 is guided radially inward and flows into an intake port 1*a* of the first-stage centrifugal impeller 1. Here, the space inside the casing 5 between the flange portion 8*a* of the intake nozzle 8, which is an introduction port for the working fluid from outside the machine, and the intake port 1*a* of the first-stage centrifugal impeller 1 is the intake flow path 7 through which the working fluid passes.

The intake flow path 7 is constituted of the flow path part 7*a* of the intake nozzle 8 which corresponds to a portion where the intake nozzle 8 exists, the annular flow path part 7*b* connected to the inner diameter side of the flow path part 7*a*, the L-shaped bend part 7*c* connected to the inner diameter side of the annular flow path part 7*b*, and an intake part 7*d* provided at a position opposite to the intake port 1*a* of the first-stage centrifugal impeller 1.

The annular flow path part 7*b* is formed in an annular shape and is provided to cause the working fluid A to turn around from side closer to the intake nozzle 8 to the side farther away (the side opposite to the intake nozzle). Further, the L-shaped bend part 7*c* is provided to redirect the working fluid A from the radially inward direction to the downstream direction of the axis X of the rotary shaft 2.

As shown in FIG. 7, a flow path for the working fluid discharged from the centrifugal impeller 1 is formed in the approximately radial direction on the radial outer diameter side of the centrifugal impeller 1 of each stage. This flow path for the working fluid forms a diffuser 10. In this example, a vaned diffuser having a plurality of vanes (blades) 10*a* spacedly arranged circumferentially is used as the diffuser 10. Note that a vaneless diffuser having no vanes 10*a* may also be used as the diffuser 10.

Downstream of the diffuser 10, a return channel 11 for changing the flow of the working fluid from a radially outward flow to a radially inward flow is formed in order to form an intake flow path to the centrifugal impeller 1 of the next stage. In this return channel 11, return vanes 11*a* are arranged at intervals in the circumferential direction to straighten the flow of the working fluid. The diffuser 10 and the return channel 11 form a stationary flow path 12.

The scroll 13 is formed on the radially outer side of the centrifugal impeller 1, which is the outlet side (downstream side) of the final-stage centrifugal impeller 1, and is configured to collect the high-pressure working fluid flowing out of the final-stage centrifugal impeller 1 and discharge it from a discharge nozzle 9 to the outside of the machine.

The above-described shaft seal device 6*c* is provided on the inner peripheral side of the casing 5 between the diffuser 10 and the return channel 11 with a small gap between the shaft seal device 6*c* and the rotary shaft 2, and prevents the working fluid discharged from the centrifugal impeller 1 of the front stage from bypassing and flowing into the rear-stage centrifugal impeller 1 without flowing into the stationary flow path 12 side.

As shown in FIG. 8, the working fluid A introduced from the flange portion 8*a* of the intake nozzle 8 passes through the flow path part 7*a* of the intake nozzle 8 and flows into the annular flow path part 7*b* from a connection portion (portion directly below the intake nozzle) 8*b* between the outlet of the flow path part 7*a* and the position of the outer diameter 7*ba* of the annular flow path part 7*b*. Here, the working fluid A flowing through the flow path part 7*a* of the intake nozzle 8 flows into the annular flow path part 7*b* and the L-shaped bend part 7*c* from the connection portion (portion directly below the intake nozzle) 8*b* being the circumferential range on the side where the intake nozzle 8 is installed, of the annular flow path part 7*b* and the L-shaped bend part 7*c*. For this reason, the flow of the working fluid at the intake port 1*a* of the first-stage centrifugal impeller 1 often exhibits a non-uniform gas flow rate distribution in the circumferential direction.

That is, as shown in FIG. 8, the working fluid A flows into the L-shaped bent part 7*c* connected to an inner diameter 7*bb* of the annular flow path part 7*b* while being turned around left and right through the annular flow path part 7*b* which exists around the entire circumference of the rotary shaft 2. Here, inside the intake flow path 7 on the opposite side of the intake nozzle 8 at the part connecting the annular flow path part 7*b* to the L-shaped bend part 7*c*, a rotation prevention plate 14 is often provided to eliminate the rotation of the flow of the working fluid A and ensure left/right symmetry. The rotation prevention plate 14 causes the working fluid A to change its flow direction toward the axis X of the rotary shaft 2 at each circumferential position of the annular flow path part 7*b* and then forms a flow field which is left-right symmetrical with respect to the center line Y of the intake flow path 7, and flows into the L-shaped bend part 7*c*. Thereafter, the working fluid A flows downstream of the axis X and is sucked into the intake port 1*a* of the first-stage centrifugal impeller 1.

Thus, in the conventional general single-shaft multi-stage centrifugal compressor having the structure in which only one intake nozzle 8 is attached, the working fluid A at the intake port 1*a* of the first-stage centrifugal impeller 1 is left-right symmetrical with respect to the center line Y of the intake flow path 7 due to the action of the annular flow path part 7*b* and the rotation prevention plate 14, but becomes an uneven flow rate distribution in the circumferential direction. Further, the working fluid A flows into the centrifugal impeller 1 in a state of having no rotation components. Although there is slight degradation in performance in the first-stage centrifugal impeller 1 due to this uneven flow rate distribution in the circumferential direction, when the single-shaft multi-stage centrifugal compressor 100 is operated only near the rated flow rate, even the single-shaft multi-stage centrifugal compressor having the conventional intake flow path structure shown in FIGS. 7 and 8 can be operated without any particular problems.

However, in the single-shaft multi-stage centrifugal compressor 100 having the conventional intake flow path structure shown in FIGS. 7 and 8, although it can be operated at the rated flow rate, no consideration is given to ensuring its stable operation over a wide range of flow rates from the rated flow rate to the small flow rate side. It is therefore difficult to ensure the stable operation especially when operating at the small flow rate other than the rated flow rate.

In order to ensure the stable operation over the wide range of flow rates from the rated flow rate to the small flow rate side, there is a need to enable switching between a state in which the working fluid is made to flow without application of pre-rotation and a state in which the working fluid is made to flow with application of pre-rotation, while increasing the uniformity of the flow rate distribution of the working fluid in the circumferential direction at the intake port 1*a* of the first-stage centrifugal impeller 1.

Figure 2:
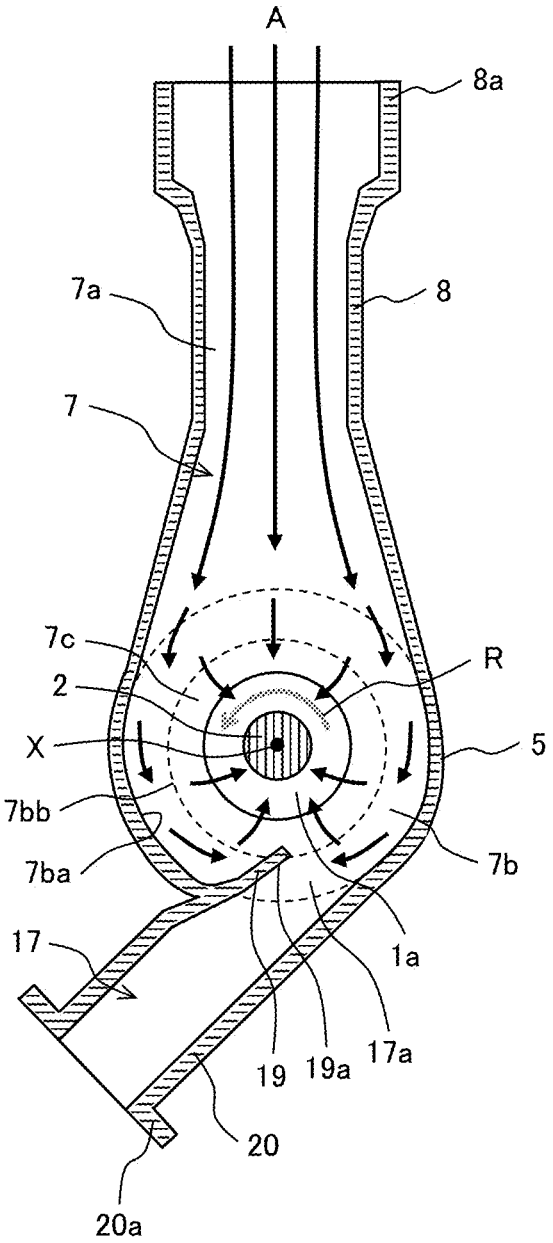
FIG. 2 is a cross-sectional view as seen in the direction indicated by arrows II, II in FIG. 1 and is a view showing a state in which fluid is flowing in only from a first intake nozzle.
Figure 3:
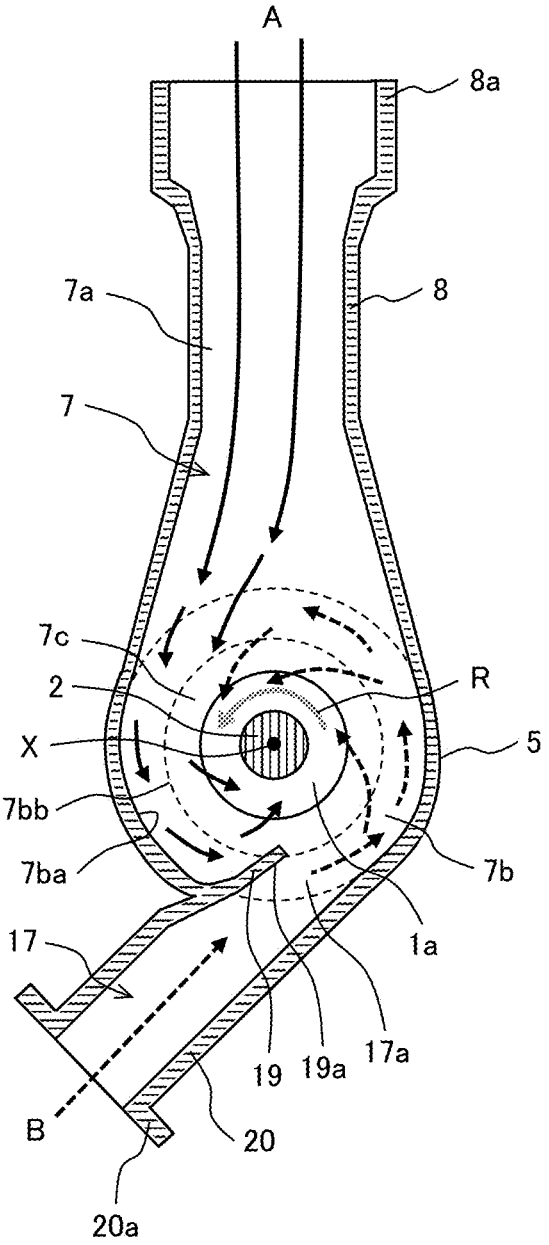
FIG. 3 is a cross-sectional view as seen in the direction indicated by arrows II, II in FIG. 1 and is a view showing a state in which fluid is flowing in from both the first intake nozzle and a second intake nozzle.

Thus, in the present embodiment, as shown in FIGS. 1 to 3, in the single-shaft multi-stage centrifugal compressor 100, a second intake nozzle 20 and a rotation prevention plate 19 are installed on a part which is opposite to the intake nozzle 8 (referred to as the first intake nozzle 8 in the following description), of a flow path wall surface corresponding to the position of the outer diameter 7*ba* of the annular flow path part 7*b*. The first intake nozzle 8 is configured to be arranged toward the direction of the rotary shaft 2, while the second intake nozzle 20 is configured to be arranged toward the direction deviated from the direction of the rotary shaft 2.

Further, the first intake nozzle 8 and the second intake nozzle 20 are provided so as to be able to adjust the amount of the working fluid introduced into the compressor from each of the intake nozzles 8 and 20. By configuring the single-shaft multi-stage centrifugal compressor having such an intake flow path structure, it is possible to adjust the amount of pre-rotation of the inflow flow of the working fluid at the intake port 1*a* of the first-stage centrifugal impeller 1, and further improve the uniformity of the flow rate distribution in the circumferential direction of the inflowing working fluid as well.

Hereinafter, the single-shaft multi-stage centrifugal compressor 100 of the present first embodiment will be described in detail with reference to FIGS. 1 to 3. FIG. 1 is a longitudinal cross-sectional view of the single-shaft multi-stage centrifugal compressor showing the first embodiment of the present invention, and FIGS. 2 and 3 are respectively cross-sectional views as seen in the direction indicated by arrows II, II in FIG. 1 and correspond to the cross-sectional views of the t intake flow path part. Further, FIG. 2 is a view showing a state in which fluid flows in only from the first intake nozzle, and FIG. 3 is a view showing a state in which fluid flows in from both the first and second intake nozzles. Note that, in the description of the present embodiment, the same reference numerals are given to the same parts as in the general single-shaft multi-stage centrifugal compressor described with reference to FIGS. 7 and 8 and their dual description will be omitted, and a description will be made concentrating on parts different from the single-shaft multi-stage centrifugal compressor shown in FIGS. 7 and 8.

As shown in FIGS. 1 to 3, the single-shaft multi-stage centrifugal compressor 100 of the present first embodiment includes a rotary shaft 2, a plurality of centrifugal impellers 1 attached in multiple stages to the rotary shaft 2, bearing devices 3 and 4 (3*a*, 4*a*: bearing cases, 3*b*, 4*b*: bearings, 3*c*: thrust bearing) which support the rotary shaft 2, and a casing 5 which houses the centrifugal impellers 1, the rotary shaft 2, etc. Further, there is provided an intake flow path 7 provided in the casing 5 on the upstream side of the first-stage centrifugal impeller 1. The intake flow path 7 is constituted of a first intake nozzle 8 having a flow path part 7*a* for introducing a working fluid (for example, a working gas such as a process gas of a plant) A, an annular flow path part 7*b* provided around the rotary shaft 2 and connected to the first intake nozzle 8, an L-shaped bend part 7*c* which is provided between the annular flow path part 7*b* and the inlet (intake port 1*a*) of the first-stage centrifugal impeller 1 and redirects the flow of the working fluid in the axial direction of the rotary shaft 2, an intake part 7*d* provided at a position opposite to the intake port 1*a* of the first-stage centrifugal impeller 1, etc. The flow path part 7*a* is an internal flow path part of the first intake nozzle 8.

Further, in the present embodiment, there is provided a second intake nozzle 20 provided on the casing 5 on the side opposite to the first intake nozzle 8 and connected to the annular flow path part 7*b*. That is, the second intake nozzle 20 is provided in a position on the side opposite to the first intake nozzle 8, of a flow path wall surface inside the casing 5 corresponding to the position of an outer diameter 7*ba* of the annular flow path part 7*b*. As shown in FIG. 3, the second intake nozzle 20 includes a flow path part 17 which is an internal flow path part of the second intake nozzle 20 and introduces a working fluid B, and a flow path part outlet 17*a* of the second intake nozzle 20 which is a connecting part between the flow path part 17 of the second intake nozzle and the annular flow path part 7*b*. Reference numeral 19 is a rotation prevention plate provided on the side opposite to the first intake nozzle 8 at the annular flow path part 7*b*.

The first intake nozzle 8 is arranged facing in the direction of the rotary shaft 2 in a manner similar to that shown in FIGS. 7 and 8. That is, in the present embodiment, the first intake nozzle 8 is provided in a direction perpendicular to the axis X of the rotary shaft 2. On the other hand, the second intake nozzle 20 is arranged facing in a direction deviated from the direction of the rotary shaft 2. That is, in the present embodiment, the second intake nozzle 20 is provided in a direction approximately tangential to the annular flow path part 7*b*.

Further, the rotation prevention plate 19 is provided so as to constitute a part of the flow path wall surface of the second intake nozzle 20. This rotation prevention plate 19 has an inclined surface 19*a* which causes the flow of the working fluid B from the second intake nozzle 20 to flow along the annular flow path part 7*b* at the flow path part outlet 17*a*. That is, the rotation prevention plate 19 in the present embodiment is configured to have the inclined surface 19*a* inclined in the same direction as the arrow indicating the direction of rotation R of the centrifugal impeller 1 from the annular flow path part 7*b* to the L-shaped bend part 7*c*.

In the present embodiment, there is provided an inflow control device which controls the inflow of the working fluid introduced into the flow path parts 7*a* and 17 from the flange portions 8*a* and 20*a* of the first and second intake nozzles 8 and 20, respectively. As the inflow control device, an on-off valve which opens and closes the inflow, or a flow rate control valve which allows the inflow rate to be adjusted, or the like is used. In the present embodiment, a description will be made about a case in which the flow rate control valve is used as the inflow control device.

That is, as shown in FIG. 1, in the present embodiment, there are provided a main pipe 22 for guiding the working fluid to the first intake nozzle 8 of the single-shaft multi-stage centrifugal compressor 100, a flow rate control valve 22*a* provided in the main pipe 22, a sub pipe 23 which branches off from the upstream side of the flow rate control valve 22*a* in the main pipe 22 to guide the working fluid to the second intake nozzle 20, and a flow rate control valve 23*a* provided in the sub pipe 23.

Note that the flow of the working fluid A introduced into the compressor from the flange portion 8*a* of the first intake nozzle 8 is represented by solid line arrows in FIGS. 2 and 3. On the other hand, the flow of the working fluid B introduced into the compressor from the flange portion 20*a* of the second intake nozzle 20 is represented by dotted line arrows in FIG. 3.

Next, a description will be made about a case where the flow rate control valve 22*a* is opened, the flow rate control valve 23*a* is closed, and the working fluid A is introduced only from the flange portion 8*a* of the first intake nozzle 8, with reference to FIG. 2. FIG. 2 shows a flow state of the working fluid A when the working fluid A is introduced into the intake flow path 7 only from the flange portion 8*a* of the first intake nozzle 8.

As shown in FIG. 2, when the working fluid A is introduced into the intake flow path 7 only from the flange portion 8*a* of the first intake nozzle 8, the flow state of the working fluid A inside the intake flow path 7 is approximately the same as the flow in the intake flow path 7 described in FIG. 8.

That is, the working fluid A flowing through the flow path part 7*a* of the first intake nozzle 8 flows into the annular flow path part 7*b* and then flows around to the left and right respectively, while due to the installation effect of the rotation prevention plate 19, the working fluid A flows into the L-shaped bend part 7*c* while changing its flow direction to the direction toward the axis X of the rotary shaft 2 at each circumferential position of the annular flow path part 7*b*. After that, the working fluid A having flowed into the L-shaped bend part 7*c* changes its flow direction to the downstream direction of the axis X, and flows from the intake part 7*d* to the intake port 1*a* of the first-stage centrifugal impeller 1.

Incidentally, in the state shown in FIG. 2, since no working fluid flows in from the flange portion 20*a* of the second intake nozzle 20, the inside of the flow path part 17 of the second intake nozzle 20 becomes a stagnant region of high static pressure with no gas flow. Therefore, the amount of the working fluid A which flows into the flow path part 17 of the second intake nozzle 20 after passing through the annular flow path part 7*b* on the right side of FIG. 2 is small.

Next, a description will be made about a case where the flow rate control valve 22*a* is opened, the flow rate control valve 23*a* is also opened, and the working fluid is introduced from both the flange portion 8*a* of the first intake nozzle 8 and the flange portion 20*a* of the second intake nozzle 20, with reference to FIG. 3. FIG. 3 shows the flow state of the working fluids A and B when the working fluid B is introduced into the annular flow path part 7*b* of the intake flow path 7 simultaneously even from the flange portion 20*a* of the second intake nozzle 20 in addition to the introduction of the working fluid A from the flange portion 8*a* of the first intake nozzle 8.

As shown in FIG. 3, when the working fluids A and B are simultaneously introduced from the first intake nozzle 8 and the second intake nozzle 20, the flow state of the working fluids inside the intake flow path 7 is as follows. The rotation prevention plate 19 provided so as to configure a part of the flow path wall surface of the second intake nozzle 20 has the inclined surface 19*a* formed so that the wall surface is inclined in the same direction as the impeller rotation direction R from the annular flow path part 7*b* to the L-shaped bend part 7*c*. Further, the second intake nozzle 20 is arranged so as to face in the direction deviated from the direction of the rotary shaft 2. With these configurations, the working fluid B introduced from the flange portion 20*a* of the second intake nozzle 20 becomes a rotating flow which rotates in the same direction as the rotation direction R of the centrifugal impeller 1. Accordingly, the working fluid B flows inside the annular flow path part 7*b* toward the direction of the first intake nozzle 8 as indicated by the dotted line arrows in FIG. 3.

A part of this flow of working fluid B flows into the L-shaped bend part 7*c* at each circumferential position of the annular flow path part 7*b* while turning in the same direction as the rotation direction R of the centrifugal impeller 1 and further changes its flow direction to the downstream direction of the axis X, and flows into the intake port 1*a* of the first-stage centrifugal impeller 1.

On the other hand, the working fluid A having flowed in from the flange portion 8*a* of the first intake nozzle 8 is pushed by the working fluid B flowing from the second intake nozzle 20 into the annular flow path part 7*b* while rotating in the same direction as the rotation direction R of the centrifugal impeller 1, and is given a rotation in the same direction and flows through the annular flow path part 7*b* in the direction in which the rotation prevention plate 19 is installed. The working fluid A flowing in the annular flow path part 7*b* while rotating in the same direction as the rotation direction R flows into the L-shaped bend part 7*c* while rotating at each circumferential position of the annular flow path part 7*b*, and further changes its flow direction to the downstream direction of the axis X to flow into the intake port 1*a* of the first-stage centrifugal impeller 1.

As described above, when the working fluid B is introduced even from the flange portion 20*a* of the second intake nozzle 20 simultaneously with the introduction of the working fluid A from the flange portion 8*a* of the first intake nozzle 8, the working fluid given the pre-rotation can be made to flow into the intake port 1*a* of the first-stage centrifugal impeller 1. Further, since the working fluids A and B are introduced from the first intake nozzle 8 and the second intake nozzle 20, respectively, the flow of the working fluid flowing into the intake port 1*a* of the first-stage centrifugal impeller 1 can be made to be a more uniform flow rate distribution in the circumferential direction.

On the other hand, in the case of the machine having only one intake nozzle as described in FIGS. 7 and 8, the working fluid A flows concentrated near the part 8*b* directly below the intake nozzle, so that the flow of the working fluid flowing into the intake port 1*a* of the first-stage centrifugal impeller 1 becomes a non-uniform flow rate distribution in the circumferential direction. Therefore, according to the present embodiment, it is possible to improve the flow of the working fluid flowing into the intake port 1*a* of the first-stage centrifugal impeller 1 and realize the single-shaft multi-stage centrifugal compressor having the more uniform flow rate distribution with high uniformity in the circumferential direction.

The above-described configuration of the present embodiment makes it possible to adjust the amount of pre-rotation of the inflow flow of the working fluid at the intake port 1*a* of the first-stage centrifugal impeller 1. As shown in FIGS. 2 and 3, in the present embodiment, the flow direction in the right annular flow path part 7*b* in FIG. 3 is reversed with respect to the flow direction in the right annular flow path part 7*b* in FIG. 2. In order to prevent an increase in pressure loss caused by the flow of the working fluid inside the annular flow path part 7*b* even when the flow direction is reversed, in the present embodiment, the cross-sectional shape of the annular flow path part 7*b* other than the vicinity of the installation locations of the second intake nozzle 20 and the rotation prevention plate 19 is configured to be approximately constant along the circumferential direction of the rotary shaft 2. By configuring in this way, the magnitudes of acceleration and deceleration of the working fluid caused by a change in the flow path cross-sectional area in the circumferential direction of the annular flow path part 7*b* can be made equal regardless of the flow direction.

The total volumetric flow rate of the working fluid sucked into the single-shaft multi-stage centrifugal compressor 100 in the present embodiment becomes the sum of the volumetric flow rates of the working fluid introduced from each of the first intake nozzle 8 and the second intake nozzle 20. Further, the flow rate distribution between the volumetric flow rate of the working fluid introduced from the first intake nozzle 8 and the volumetric flow rate of the working fluid introduced from the second intake nozzle 20 can be adjusted arbitrarily by adjusting the opening degree of the flow rate control valve 22*a* and the opening degree of the flow rate control valve 23*a*.

For example, in the cases of when operating at a rated flow rate, etc., when no pre-rotation is applied to the working fluid sucked into the first-stage centrifugal impeller 1, the flow rate control valve 22*a* can be opened 100% (fully opened), the flow rate control valve 23*a* can be opened 0% (fully closed), and the flow rate distribution can be set to "100:0". Also, in the cases of when it is desired to operate on the small flow rate side, etc., when operating with pre-rotation applied to the working fluid sucked into the first-stage centrifugal impeller 1, the flow rate distribution can be set to "50:50" if the degree of opening of the flow rate control valve 22*a* is set to 50% and the degree of opening of the flow rate control valve 23*a* is also set to 50%, for example, the operating range can be expanded to the small flow rate side by applying pre-rotation, and the uniformity of the circumferential distribution of the flow to the centrifugal impeller 1 can also be improved. By adjusting the flow rate distribution in this way, stable operation can be made over a wide flow rate range from the rated flow rate to the small flow rate side.

Incidentally, the flow rate distribution is not limited to "100:0" or "50:50", and the flow rate distribution between the volumetric flow rate of the working fluid introduced from the first intake nozzle 8 and the volumetric flow rate of the working fluid introduced from the second intake nozzle 20 can be adjusted arbitrarily according to a desired total volumetric flow rate. The magnitude of the rotation component of the rotating flow generated in the intake flow path 7 is determined as follows. That is, the magnitude of the flow velocity in the mounting direction of the second intake nozzle 20 is determined from the flow rate of the working fluid B introduced from the flange portion 20*a* of the second intake nozzle 20 and the flow path cross-sectional area at the flow path part outlet 17*a* of the second intake nozzle 20, whereby the magnitude of the rotation component is determined. Therefore, when it is desired to increase the amount of pre-rotation of the inflow flow to the first-stage centrifugal impeller 1, the flow rate control valve 23*a* is adjusted so that the flow rate of the working fluid B introduced from the flange portion 20*a* of the second intake nozzle 20 is increased.

Incidentally, in the description of the present embodiment, the flow rate distribution between the volumetric flow rate of the working fluid introduced from the first intake nozzle 8 and the volumetric flow rate of the working fluid introduced from the second intake nozzle 20 is adjusted by the flow rate control valves 22*a* and 23*a*, but it may be configured as follows. That is, the flow path cross-sectional area of the second intake nozzle 20 is configured to be smaller than the flow path cross-sectional area of the first intake nozzle 8, and the inflow to the second intake nozzle 20 is controlled by an on-off valve. When pre-rotation is applied to allow the working fluid to flow into the centrifugal impeller 1, the on-off valve is opened to thereby enable the working fluid having the flow rate smaller than the amount of inflow from the first intake nozzle 8 to be introduced from the second intake nozzle 20 into the annular flow path part 7*b*. When the flow rate control device is used as an on-off valve, the flow rate cannot be adjusted, but it is possible to operate with a predetermined flow rate distribution by configuring the second intake nozzle to be smaller in nozzle size than the first intake nozzle.

Note that the situation in which such a uniform pre-rotation flow as shown in FIG. 3 is caused to flow into the first-stage centrifugal impeller 1 is one in which the total volumetric flow rate of the working fluid is significantly reduced from the rated flow rate. For example, when the rated flow rate is assumed to be 100%, it is a situation in which the flow rate of the working fluid is reduced to less than 70% of the rated flow rate. The first intake nozzle 8 is basically designed to match the operating conditions shown in FIG. 2 in which no pre-rotation is applied, that is, operating conditions in which the working fluid equivalent to the rated flow rate is introduced only from the first intake nozzle 8, thereby preventing the flow velocity in the flow path part 7*a* of the first intake nozzle 8 from becoming excessively high.

On the other hand, in the case of the operation given such pre-rotation as shown in FIG. 3, it becomes under the condition in which the total volumetric flow rate of the intake gas is less than, for example, 70% of the rated flow rate. Therefore, even if all the working fluid is introduced from the second intake nozzle 20 to increase the amount of pre-rotation of the inflow flow of the first-stage centrifugal impeller 1, the flow rate of the working fluid introduced from the second intake nozzle 20 is smaller than the rated flow rate. It is therefore desirable to make the nozzle size of the second intake nozzle 20 smaller than that of the first intake nozzle 8.

Further, it is preferable to configure the annular flow path part 7*b* so that its flow path cross-sectional shape becomes approximately constant in the circumferential direction. In the case of applying the pre-rotation as shown in FIG. 3 when the flow path cross-sectional shape of the annular flow path part 7*b* is made approximately constant, when the amount of the working fluid introduced from the second intake nozzle 20 is extremely increased relative to the amount of the working fluid introduced from the first intake nozzle 8 in order to increase the amount of pre-rotation, the flow rate of the working fluid passing through the L-shaped bend part 7*c* and flowing into the intake port 1*a* of the first-stage centrifugal impeller 1 becomes the largest in the vicinity of the flow path part outlet 17*a* of the second intake nozzle 20, and gradually decreases as it proceeds counter-clockwise from there through the annular flow path part 7*b*, thereby becoming the smallest near the installation position of the rotation prevention plate 19. Therefore, the circumferential distribution uniformity of the flow rate of the inflow into the first-stage centrifugal impeller 1 at the time of application of the pre-rotation is deteriorated.

In order to improve the uniformity of the circumferential distribution of the flow rate of the inflow into the first-stage centrifugal impeller 1 at the time of application of the pre-rotation, it is preferable to adjust the flow rate of the working fluid introduced from the second intake nozzle 20 and the flow rate of the working fluid introduced from the first intake nozzle 8 so that they are made to be as equal as possible.

Further, it is desirable to adjust the ratio (flow rate distribution) between the flow rate of the working fluid introduced from the second intake nozzle 20 and the flow rate of the working fluid introduced from the first intake nozzle 8, while taking into consideration the balance between the magnitude of the amount of pre-rotation applied to the first-stage centrifugal impeller 1 and the level of uniformity of the circumferential distribution of the inflow flow rate to the first-stage centrifugal impeller 1 at the time of application of the pre-rotation.

As described in FIGS. 2 and 3, in the present embodiment, the rotation prevention plate 19 is configured to have the inclined surface 19*a* inclined in the same direction as the rotation direction R of the centrifugal impeller 1 from the annular flow path part 7*b* to the L-shaped bend part 7*c*. The reason for this is aimed at exerting the effect of preventing rotation by the rotation prevention plate 19 when no pre-rotation is applied as shown in FIG. 2, and exerting the effect of assisting in the formation of a rotation flow by the working fluid flowing in from the second intake nozzle 20 when the pre-rotation is applied as shown in FIG. 3.

The single-shaft multi-stage centrifugal compressor 100 of the present embodiment is expected to be applied to various plantes, but is effective therein for a case where it is required to ensure stable operation over a wide range of flow rates from the rated flow rate to the small air volume side while maintaining the rated discharge pressure for the single-shaft multi-stage centrifugal compressor to be installed. For example, it is particularly effective as a single-shaft multi-stage centrifugal compressor in synthesis plants for ammonia, methanol, etc. This is because the synthesis gas compressor used in these plants is required to stably operate over a wide range of flow rates from the rated flow rate to the small air volume side according to a desired gas synthesis amount while maintaining the gas pressure required for the synthesis of ammonia or methanol.

Further, in each plant in which electric power derived from solar power generation is used as power for driving the synthesis gas compressor, the power generation amount changes significantly between day and night. Therefore, it is necessary to significantly change the amount of gas synthesis as well from the rated flow rate (daytime) to the small air volume (nighttime). In the synthesis gas compressor used in such a plant, the single-shaft multi-stage centrifugal compressor 100 is operated during the day in the state in which such pre-rotation as shown in FIG. 2 is not applied, and the single-shaft multi-stage centrifugal compressor 100 is operated in the state in which such pre-rotation as shown in FIG. 3 is applied, during the night in which it is desired to reduce the amount of intake gas. This makes it effective to operate the compressor while adjusting the flow rate introduced from the first intake nozzle 8 and the flow rate introduced from the second intake nozzle 20 during the day and the night.

According to the present embodiment, the pre-rotation can be applied to the working fluid from the intake nozzle without using an inlet guide vane, so that it is possible to obtain a single-shaft multi-stage centrifugal compressor capable of improving its reliability and suppressing the unevenness in the flow rate distribution as well.

That is, it is possible to switch between the state in which the working fluid flows into the first-stage centrifugal impeller 1 downstream of the intake flow path without applying the pre-rotation and the state in which the working fluid flows therein with the pre-rotation applied, with a relatively simple structure. It is also possible to improve the uniformity of the circumferential distribution of the inflow flow into the first-stage centrifugal impeller 1 when the pre-rotation is applied.

Next, a description will be made about a modification of the rotation prevention plate 19 described in the first embodiment of the present invention with reference to FIGS. 4 and 5. The shape of the rotation prevention plate 19 described in the first embodiment is not limited to that shown in FIGS. 2 and 3, and may be, for example, such a rotation prevention plate 19 as shown in FIGS. 4 and 5.

Figure 4:
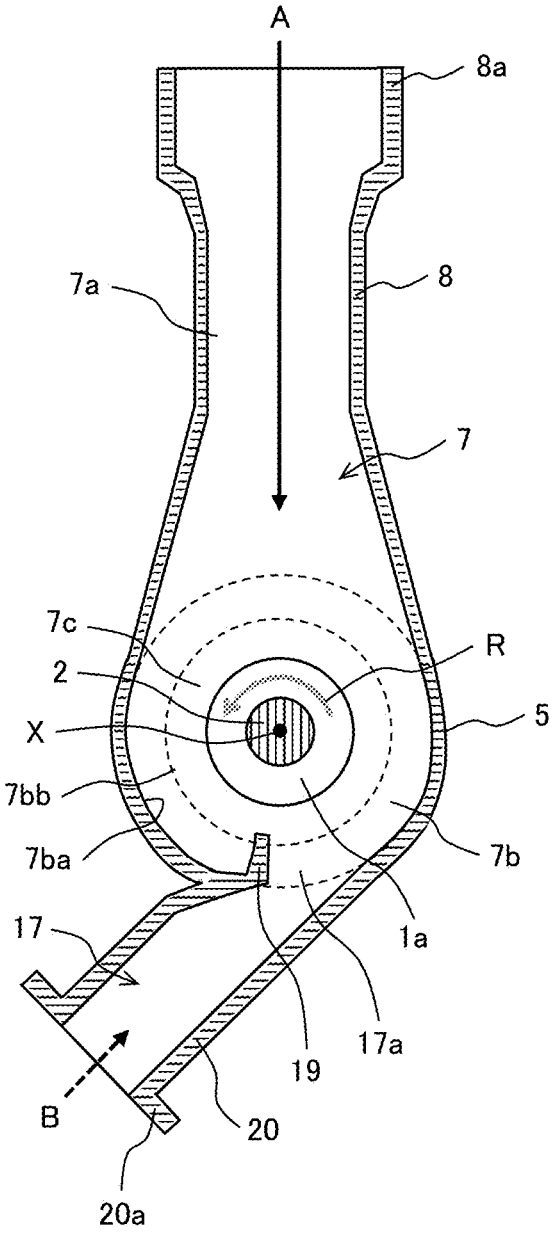
FIG. 4 is a view describing a modification of the first embodiment of the present invention and is a view corresponding to FIG. 3.

FIG. 4 is a view describing the modification of the first embodiment of the present invention and is a view corresponding to FIG. 3. In the example shown in FIG. 4, the shape of the rotation prevention plate 19 is configured to face the direction of the rotary shaft 2 in order to increase the rotation prevention effect of the rotation prevention plate 19.

Figure 5:
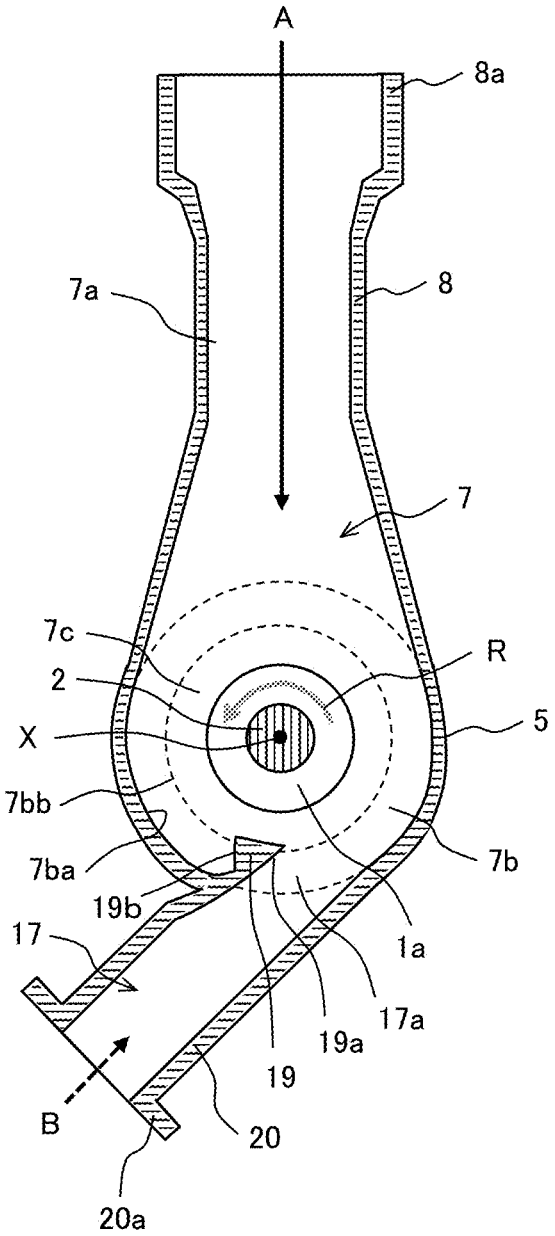
FIG. 5 is a view describing another modification of the first embodiment of the present invention and is a view corresponding to FIG. 3.

FIG. 5 is a view describing another modification of the first embodiment of the present invention and is a view corresponding to FIG. 3. In the example shown in FIG. 5, in order to provide both the auxiliary effect of the rotation prevention plate 19 for forming a rotation flow and the rotation prevention effect, the rotation prevention plate 19 is configured to be a shape having an inclined surface 19*a* similar to that of FIG. 3 and a rotation prevention surface 19*b* for further enhancing the rotation prevention effect.

Second Embodiment

Figure 6:
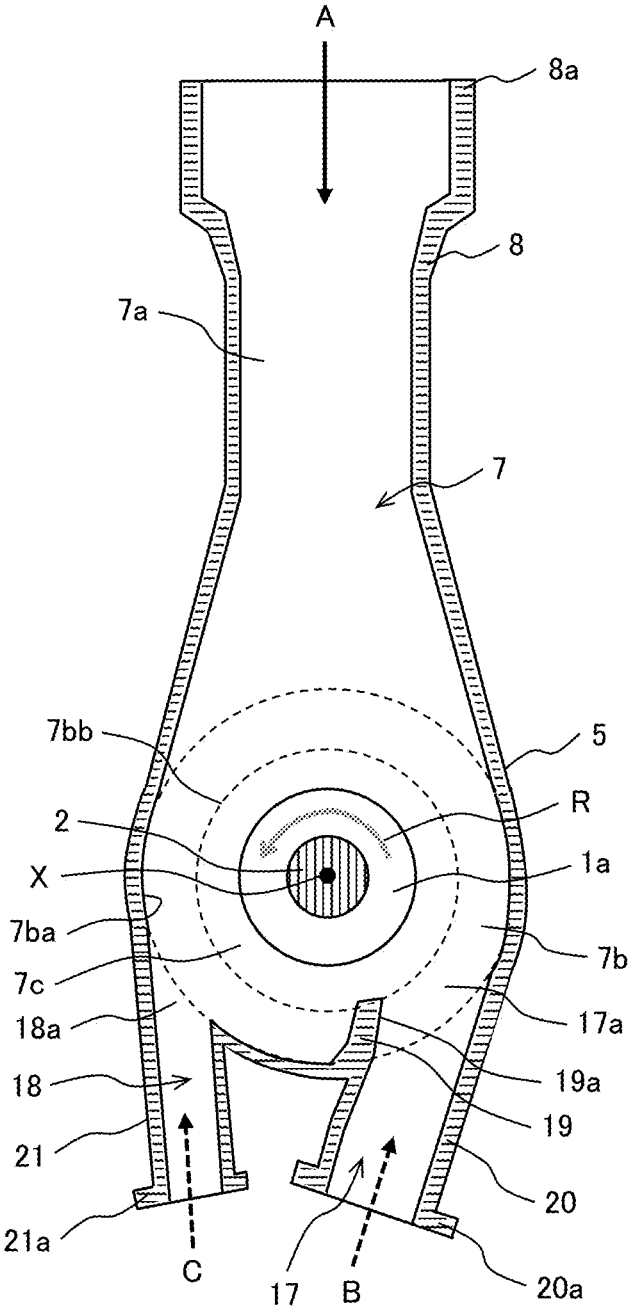
FIG. 6 is a view describing an embodiment 2 of a single-shaft multi-stage centrifugal compressor of the present invention and is a view corresponding to FIG. 3.

A second embodiment of the present invention will hereinafter be described with reference to FIG. 6. FIG. 6 is a view describing the second embodiment of the single-shaft multi-stage centrifugal compressor of the present invention and is a view corresponding to FIG. 3. In the description of this second embodiment, the description of the same parts as in the first embodiment described above is omitted, and the description will be made concentrated on the parts different from those in the first embodiment.

As shown in FIG. 6, the intake flow path 7 in the present second embodiment has a flow path part 7*a* which is the internal flow path part of the first intake nozzle 8, and an annular flow path part 7*b*. Further, a second intake nozzle 20 and a third intake nozzle 21 are installed at a position which is on the opposite side to the first intake nozzle 8, of the flow path wall surface inside the casing 5 corresponding to the position of the outer diameter 7*ba* of the annular flow path part 7*b*. The second intake nozzle 20 is formed with a flow path part 17 which is its internal flow path part. The third intake nozzle 21 is formed with a flow path part 18 which is its internal flow path part.

Further, at the position on the opposite side to the first intake nozzle 8 on the flow path wall surface inside the casing 5 corresponding to the position of the outer diameter 7*ba* of the annular flow path part 7*b*, a rotation prevention plate 19 is provided near the installation position of the second intake nozzle 20 so as to configure part of the flow path wall surface of the second intake nozzle 20. As in the first embodiment, the rotation prevention plate 19 is provided with an inclined surface 19*a* which is inclined in the same direction as the impeller rotation direction R from the annular flow path part 7*b* to the L-shaped bend part 7*c*.

As in the first embodiment, the first intake nozzle 8 is arranged so as to face the direction of the rotary shaft 2. Further, the second intake nozzle 20 and the third intake nozzle 21 are both arranged so as to face in a direction shifted from the direction of the rotary shaft 2. Furthermore, the second intake nozzle 20 and the third intake nozzle 21 are respectively arranged on the left and right of the annular flow path part 7*b* so as to sandwich the rotation prevention plate 19.

These first, second and third intake nozzles 8, 20, and 21 are configured to be capable of adjusting the flow rate of the inflow working fluid introduced into the intake flow path 7 from the flange portions 8*a*, 20*a*, and 21*a*, respectively. That is, the main pipe 22 shown in FIG. 1 is connected to the first intake nozzle 8. The main pipe 22 is provided with a flow rate control valve 22*a*. Also, as shown in FIG. 1, the sub pipe 23 branching off from the main pipe 22 is connected to each of the second and third intake nozzles 20 and 21, and each sub pipe 23 is also provided with the flow rate control valve 23*a*.

Note that other configurations are similar to those of the first embodiment described above.

The following effects can be obtained by adopting the configuration of the present second embodiment described above.

That is, it the working fluid is introduced into the intake flow path 7 only from the first intake nozzle 8, the inflow state of the working fluid with no pre-rotation relative to the first-stage centrifugal impeller 1 can be realized as in FIG. 2.

Further, if the working fluid is introduced into the intake flow path 7 simultaneously from the first intake nozzle 8 and the second intake nozzle 20, the state in which the working fluid with the pre-rotation in the same direction as the rotation direction R of the first-stage centrifugal impeller 1 applied thereto flows therein can be realized as in FIG. 3.

On the other hand, if the working fluid is introduced into the intake flow path 7 simultaneously from the first intake nozzle 8 and the third intake nozzle 21, the state in which the working fluid with the reverse pre-rotation in the direction opposite to the rotation direction R of the first-stage centrifugal impeller 1 applied thereto flows therein can be realized. When the reverse pre-rotation is applied to the first-stage centrifugal impeller 1, it is possible to increase a rise in pressure in the first-stage centrifugal impeller 1, and to increase the discharge pressure of the single-shaft multi-stage centrifugal compressor 100.

By adopting the configuration of the present second embodiment in this manner, it is possible to have both of an increase in the compressor discharge pressure near the rated flow rate and an expansion of the stable operation range toward the small air volume side.

Incidentally, even in the present second embodiment, the following configuration may be adopted as in the first embodiment described above.

That is, it is preferable that the flow path cross-sectional shape of the annular flow path part 7*b* is approximately constant in the circumferential direction. Also, it is preferable that the second intake nozzle 20 and the third intake nozzle 21 are made smaller in nozzle size than the first intake nozzle 8. Further, it is preferable to adjust the ratio (flow rate distribution) between the flow rate of the working fluid introduced from the second intake nozzle 20 or the third intake nozzle 21 and the flow rate of the working fluid introduced from the first intake nozzle 8, while taking into consideration the balance between the magnitude of the amount of pre-rotation applied to the first-stage centrifugal impeller 1 and the uniformity of the circumferential distribution of the inflow flow rate to the first-stage centrifugal impeller 1 at the time of application of the pre-rotation. In addition, the shape of the rotation prevention plate 19 may be configured to make a rotation prevention effect larger as in the rotation prevention plate 19 shown in FIG. 4 or to have both the rotation prevention effect and the auxiliary effect of forming a rotation flow as in the rotation prevention plate 19 shown in FIG. 5.

As for applications of the single-shaft multi-stage centrifugal compressor 100 described in the present second embodiment, similarly to the single-shaft multi-stage centrifugal compressor of the first embodiment, it is particularly suitable for use as a synthesis gas compressor used in synthesis plants for ammonia, methanol, etc., in which electric power derived from solar power generation is used as power for driving the compressor.

It should be noted that the present invention is not limited to the examples described above, and includes various modification examples. For example, in the above-described embodiment, the description has been made about the case where the present invention is applied to the single-shaft multi-stage centrifugal compressor, but the present invention is not limited to the single-shaft multi-stage centrifugal compressor. Even a single-stage centrifugal compressor, the present invention can be similarly applied thereto as long as it has an intake flow path which introduces the working fluid from the radial direction of the rotary shaft and causes it to flow into the centrifugal impeller. Also, the present invention is not limited to the compressors, and can be similarly applied even to centrifugal fluid machines such as a single-shaft multi-stage centrifugal pump, and others. Further, the present invention is not limited to synthesis gas compressors used in synthesis plants for ammonia, methanol, etc., and can be applied as compressors for various other plants.

Further, the embodiments described above have been described in detail to simply describe the present invention, and are not necessarily required to include all the described configurations.

REFERENCE SIGNS LIST

1: centrifugal impeller, la: intake port, 2: rotary shaft, 3: bearing device, 3*a*: bearing case, 3*b*: bearing, 3*c*: thrust bearing, 4: bearing device, 4*a*: bearing case, 4*b*: bearing, 5: casing, 6 (6*a*, 6*b*, 6*c*): shaft seal device, 7: intake flow path, 7*a*: flow path part, 7*b*: annular flow path part, 7*ba*: outer diameter of annular flow path, 7*bb*: inner diameter of annular flow path, 7*c*: L-shaped bend part, 7*d*: intake part, 8: first intake nozzle (intake nozzle), 8*a*: flange portion, 8*b*: connection portion (portion directly below intake nozzle), 9: discharge nozzle, 10: diffuser, 10*a*: vane, 11: return channel, 11*a*: return vane, 12: stationary flow path, 13: scroll, 14: rotation prevention plate, 17, 18: flow path part, 17*a*, 18*a*: flow path part outlet, 19: rotation prevention plate, 19*a*: inclined surface, 19*b*: rotation prevention surface, 20: second intake nozzle, 20*a*: flange portion, 21: third intake nozzle, 21*a*: flange portion, 22: main pipe, 22*a*: flow rate control valve, 23: sub pipe, 23*a*: flow rate control valve, 100: single-shaft multi-stage centrifugal compressor, A, B, C: working fluid (A: flow direction of working fluid from first intake nozzle, B: flow direction of working fluid from second intake nozzle, C: flow direction of working fluid from third intake nozzle), R: rotation direction, X: axis, Y: center line.

The invention claimed is:

1. A centrifugal fluid machine comprising:

a rotary shaft;

a centrifugal impeller attached to the rotary shaft;

a bearing supporting the rotary shaft; and a casing accommodating the rotary shaft, the centrifugal impeller, and the bearing, wherein the centrifugal fluid machine includes an intake flow path which is provided in the casing on the upstream side of the centrifugal impeller and introduces a working fluid from a radial direction of the rotary shaft to cause the working fluid to flow into the centrifugal impeller, the intake flow path includes:

a first intake nozzle introducing the working fluid;

an annular flow path part provided around the rotary shaft and connected to the first intake nozzle;

an L-shaped bend part which is provided between the annular flow path part and an inlet of the centrifugal impeller and redirects a flow of the working fluid in an axial direction of the rotary shaft;

a second intake nozzle provided in the casing on the side opposite to the first intake nozzle in the annular flow path part and connected to the annular flow path part; and a rotation prevention plate provided on the side opposite to the first intake nozzle in the annular flow path part, the first intake nozzle is arranged toward a direction of the rotary shaft, and the second intake nozzle is arranged in a direction deviated from the direction of the rotary shaft, and the first intake nozzle and the second intake nozzle are each equipped with an inflow control device composed of a valve which controls an inflow of the working fluid introduced into a flow path part from each of the first intake nozzle and the second intake nozzle.

2. A single-shaft multi-stage centrifugal compressor comprising:

a rotary shaft;

a plurality of centrifugal impellers attached to the rotary shaft;

a bearing supporting the rotary shaft; and a casing accommodating the rotary shaft, the centrifugal impellers, and the bearing, wherein the single-shaft multi-stage centrifugal compressor includes an intake flow path provided in the casing on the upstream side of the first-stage centrifugal impeller, the intake flow path includes:

a first intake nozzle which introduces a working fluid;

an annular flow path part provided around the rotary shaft and connected to the first intake nozzle;

an L-shaped bend part which is provided between the annular flow path part and an inlet of the first-stage centrifugal impeller and redirects a flow of the working fluid in an axial direction of the rotary shaft;

a second intake nozzle provided in the casing on the side opposite to the first intake nozzle in the annular flow path part and connected to the annular flow path part; and a rotation prevention plate provided on the side opposite to the first intake nozzle in the annular flow path part, the first intake nozzle is arranged toward a direction of the rotary shaft, and the second intake nozzle is arranged in a direction deviated from the direction of the rotary shaft, and the first intake nozzle and the second intake nozzle are each equipped with an inflow control device composed of a valve which controls an inflow of the working fluid introduced from each of the first and second intake nozzles into the compressor.

3. The single-shaft multi-stage centrifugal compressor according to claim 2, wherein the annular flow path part other than the installation locations of the second intake nozzle and the rotation prevention plate is configured to be approximately constant in cross-sectional shape along the circumferential direction of the rotary shaft.

4. The single-shaft multi-stage centrifugal compressor according to claim 2, wherein the second intake nozzle is configured to be smaller in nozzle size than the first intake nozzle.

5. The single-shaft multi-stage centrifugal compressor according to claim 2, including a main pipe for guiding the working fluid to the first intake nozzle, and a sub pipe for guiding the working fluid to the second intake nozzle.

6. The single-shaft multi-stage centrifugal compressor according to claim 5, wherein the inflow control device which controls the inflow of the working fluid is a flow rate control valve or an on-off valve provided in each of the main pipe and the sub pipe.

7. The single-shaft multi-stage centrifugal compressor according to claim 6, wherein the sub pipe is a pipe which branches off from the upstream side of the inflow control device in the main pipe and guides the working fluid to the second intake nozzle.

8. The single-shaft multi-stage centrifugal compressor according to claim 2, wherein the rotation prevention plate is configured to have at least either an inclined surface inclined in a rotation direction of the rotary shaft or a rotation prevention surface for preventing rotation.

9. The single-shaft multi-stage centrifugal compressor according to claim 2, wherein the single-shaft multi-stage centrifugal compressor is used as a synthesis compressor which synthesizes ammonia, methanol, or the like.

10. A single-shaft multi-stage centrifugal compressor comprising:

a rotary shaft;

a plurality of centrifugal impellers attached to the rotary shaft;

a bearing supporting the rotary shaft; and a casing accommodating the rotary shaft, the centrifugal impellers, and the bearing, wherein the single-shaft multi-stage centrifugal compressor includes an intake flow path provided in the casing on the upstream side of the first-stage centrifugal impeller, the intake flow path includes:

a first intake nozzle which introduces a working fluid;

an annular flow path part provided around the rotary shaft and connected to the first intake nozzle;

an L-shaped bend part which is provided between the annular flow path part and an inlet of the first-stage centrifugal impeller and redirects a flow of the working fluid in an axial direction of the rotary shaft;

a second intake nozzle provided in the casing on the side opposite to the first intake nozzle in the annular flow path part and connected to the annular flow path part;

a third intake nozzle provided in the casing between the first intake nozzle and the second intake nozzle and connected to the annular flow path part; and a rotation prevention plate provided on the side opposite to the first intake nozzle in the annular flow path part, the first intake nozzle is arranged toward a direction of the rotary shaft, and the second intake nozzle and the third intake nozzle are arranged toward a direction deviated from the direction of the rotary shaft, the second intake nozzle and the third intake nozzle are arranged on the left and right of the rotation prevention plate so as to sandwich the rotation prevention plate, and the first intake nozzle, the second intake nozzle, and the third intake nozzle each include an inflow control device composed of a valve which controls an inflow of the working fluid introduced from each intake nozzle into the compressor.

11. The single-shaft multi-stage centrifugal compressor according to claim 10, wherein the annular flow path part other than the installation locations of the second intake nozzle, the third intake nozzle, and the rotation prevention plate is configured to be approximately constant in cross-sectional shape along the circumferential direction of the rotary shaft.

12. The single-shaft multi-stage centrifugal compressor according to claim 10, wherein the second intake nozzle and the third intake nozzle are configured to be smaller in nozzle size than the first intake nozzle.

13. The single-shaft multi-stage centrifugal compressor according to claim 10, including a main pipe for guiding the working fluid to the first intake nozzle, a sub pipe for guiding the working fluid to the second intake nozzle, and a sub pipe for guiding the working fluid to the third intake nozzle.

14. The single-shaft multi-stage centrifugal compressor according to claim 13, wherein the inflow control device which controls the inflow of the working fluid is a flow rate control valve or an on-off valve provided in each of the main pipe, the sub pipe for guiding the working fluid to the second intake nozzle, and the sub pipe for guiding the working fluid to the third intake nozzle.

15. The single-shaft multi-stage centrifugal compressor according to claim 14, wherein each of the sub pipe for guiding the working fluid to the second intake nozzle and the sub pipe for guiding the working fluid to the third intake nozzle is a pipe which branches off from the upstream side of the inflow control device in the main pipe and guides the working fluid to the second intake nozzle or the third intake nozzle.

* * * * *